US010597591B2

(12) United States Patent
Weiss et al.

(10) Patent No.: US 10,597,591 B2
(45) Date of Patent: Mar. 24, 2020

(54) CONVERSION PROCESS COMPRISING PERMUTABLE HYDRODEMETALLIZATION GUARD BEDS, A FIXED-BED HYDROTREATMENT STEP AND A HYDROCRACKING STEP IN PERMUTABLE REACTORS

(71) Applicant: IFP ENERGIES NOUVELLES, Rueil-Malmaison (FR)

(72) Inventors: Wilfried Weiss, Valencin (FR); Elodie Tellier, Lyons (FR); Pascal Chatron-Michaud, Lyons (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 0 days.

(21) Appl. No.: 16/097,461

(22) PCT Filed: Apr. 11, 2017

(86) PCT No.: PCT/EP2017/058686
§ 371 (c)(1),
(2) Date: Oct. 29, 2018

(87) PCT Pub. No.: WO2017/186484
PCT Pub. Date: Nov. 2, 2017

(65) Prior Publication Data

US 2019/0153340 A1 May 23, 2019

(30) Foreign Application Priority Data

Apr. 27, 2016 (FR) ..... 16 53751

(51) Int. Cl.
*C10G 67/14* (2006.01)
*C01G 21/14* (2006.01)
(Continued)

(52) U.S. Cl.
CPC ..... *C10G 67/14* (2013.01); *C10G 7/06* (2013.01); *C10G 21/14* (2013.01); *C10G 27/12* (2013.01);
(Continued)

(58) Field of Classification Search
None
See application file for complete search history.

(56) References Cited

U.S. PATENT DOCUMENTS 7,407,571 B2 * 8/2008 Rettger ..... C10G 49/007 196/100
9,896,630 B2 2/2018 Weiss et al.
(Continued)

FOREIGN PATENT DOCUMENTS

FR 2983866 B1 1/2015
FR 3013723 B1 8/2016

OTHER PUBLICATIONS

International Search Report PCT/EP2017/058686 dated May 31, 2017 (pp. 1-4).

*Primary Examiner* — Tam M Nguyen
(74) *Attorney, Agent, or Firm* — Millen, White, Zelano and Branigan, P.C.

(57) ABSTRACT

The invention relates to a process for the treatment of a hydrocarbon-containing feedstock making it possible to obtain a heavy hydrocarbon-containing fraction having a low sulphur content, said process comprising the following stages: a) a stage of hydrodemetallization in permutable reactors b) a stage of fixed-bed hydrotreatment of the effluent originating from stage a), c) a stage of hydrocracking in permutable reactors of the effluent originating from stage b), d) a stage of separation of the effluent originating from stage c), e) a stage of precipitation of the sediments, f) a stage of physical separation of said sediments from the
(Continued)

heavy liquid fraction originating from stage d), g) a stage of recovery of the distillate cut used in stage e).

15 Claims, 2 Drawing Sheets

(51) Int. Cl.

| | |
|---|---|
| ***C10G 31/10*** | (2006.01) |
| ***C10G 21/14*** | (2006.01) |
| ***C10G 31/09*** | (2006.01) |
| ***C10G 32/02*** | (2006.01) |
| ***C10G 47/12*** | (2006.01) |
| ***C10G 27/12*** | (2006.01) |
| ***C10G 65/12*** | (2006.01) |
| ***C10G 7/06*** | (2006.01) |
| ***C10G 65/04*** | (2006.01) |
| ***C10G 45/08*** | (2006.01) |

(52) U.S. Cl.
CPC ..... *C10G 31/09* (2013.01); *C10G 31/10* (2013.01); *C10G 32/02* (2013.01); *C10G 45/08* (2013.01); *C10G 47/12* (2013.01); *C10G 65/04* (2013.01); *C10G 65/12* (2013.01); *C10G 2300/1077* (2013.01); *C10G 2300/202* (2013.01); *C10G 2300/205* (2013.01); *C10G 2300/206* (2013.01); *C10G 2300/208* (2013.01)

(56) References Cited

U.S. PATENT DOCUMENTS

| | | | | |
|---|---|---|---|---|
| 2007/0187294 | A1 | 8/2007 | Ancheyta Juarez et al. | |
| 2009/0261016 | A1* | 10/2009 | Marchionna ..... | C10G 67/049 208/57 |
| 2014/0332444 | A1 | 11/2014 | Weiss et al. | |
| 2016/0122665 | A1* | 5/2016 | Weiss ..... | C10G 67/02 208/57 |
| 2016/0160136 | A1* | 6/2016 | Weiss ..... | C10G 31/06 208/97 |
| 2016/0177200 | A1* | 6/2016 | Powell ..... | C10G 47/12 208/124 |

* cited by examiner

CONVERSION PROCESS COMPRISING PERMUTABLE HYDRODEMETALLIZATION GUARD BEDS, A FIXED-BED HYDROTREATMENT STEP AND A HYDROCRACKING STEP IN PERMUTABLE REACTORS

CONTEXT OF THE INVENTION

The present invention relates to the refining and conversion of heavy hydrocarbon fractions containing, among other things, sulphur-containing impurities. It relates more particularly to a process for converting heavy petroleum feedstocks of the atmospheric residue and/or vacuum residue type for the production of heavy fractions that can be used as fuel-oil bases, in particular bunker oil bases, with a low sediment content. The process according to the invention also makes it possible to produce atmospheric distillates (naphtha, kerosene and diesel), vacuum distillates and light gases (C1 to C4).

The quality requirements for marine fuels are described in standard ISO 8217. From now on the specification concerning sulphur will relate to SOx emissions (Annex VI of the MARPOL convention of the International Maritime Organization) and is expressed as a recommendation for the sulphur content to be less than or equal to 0.5% by weight outside the Sulphur Emissions Control Areas (SECAs) or Emissions Control Areas (ECAs) for the 2020-2025 time frame, and less than or equal to 0.1% by weight in the SECAs. Another very restrictive recommendation is the sediment content after ageing according to ISO 10307-2 (also known as IP390), which must be less than or equal to 0.1%.

The sediment content according to ISO 10307-1 (also known as IP375) is different from the sediment content after ageing according to ISO 10307-2 (also known as IP390). The sediment content after ageing according to ISO 10307-2 is a much more restrictive specification and corresponds to the specification that applies to bunker oils.

According to Annex VI of the MARPOL convention, a ship will therefore be able to use a sulphur-containing fuel oil if the ship is equipped with a system for treating fumes that makes it possible to reduce emissions of sulphur oxides.

The fuel oils used in maritime transport generally comprise atmospheric distillates, vacuum distillates, atmospheric residues and vacuum residues originating from direct distillation or originating from a refining process, in particular from hydrotreatment and conversion processes, these cuts being able to be used alone or in a mixture. Although these processes are known to be suitable for heavy feedstocks laden with impurities, they nevertheless produce hydrocarbon-containing fractions that may comprise catalyst fines and/or sediments that must be removed to satisfy a product quality such as bunker oil.

The sediments can be precipitated asphaltenes. In the feedstock, initially, the conversion conditions and in particular the temperature cause the asphaltenes to undergo reactions (dealkylation, polycondensation, etc.) that result in precipitation thereof. In addition to the existing sediments in the heavy cut at the end of the process (measured according to ISO 10307-1 also known as IP375), there are also, depending on the conversion conditions, sediments categorized as potential sediments, which only appear after a physical, chemical and/or thermal treatment. All of the sediments including the potential sediments are measured according to ISO 10307-1, also known as IP390. These phenomena are generally involved when harsh conditions are implemented, resulting in high conversion levels, for example greater than 40 or 50% or even more, depending on the nature of the feedstock.

The conversion rate is defined as being the mass fraction of organic compounds having a boiling point above 520° C. in the feedstock at the inlet of the reaction section minus the mass fraction of organic compounds having a boiling point above 520° C. in the effluent at the outlet of the reaction section, the total divided by the mass fraction of organic compounds in the feedstock having a boiling point above 520° C. at the inlet of the reaction section. In the processes for treating residues, there is an economic benefit to maximizing the conversion, due to the fact that the conversion products, in particular the distillates, are generally more suitable for upgrading than the feedstock or the unconverted fraction.

In fixed-bed hydrotreatment processes, the temperature is generally lower than in the ebullating-bed or slurry-bed hydrocracking processes. The conversion rate in a fixed bed is thus generally lower, but implementation is simpler than in an ebullating bed or slurry bed. Thus the conversion rate of the fixed-bed hydrotreatment processes is moderate or even low, generally less than 45%, most often less than 35% at the end of the cycle, and less than 25% at the start of the cycle. The conversion rate generally varies during the cycle due to the increase in temperature in order to compensate for catalyst deactivation.

In fact, the production of sediments is generally lower in the fixed-bed hydrotreatment processes than in the ebullating-bed or slurry-bed hydrocracking processes. However, the temperatures reached from the middle of the cycle and up to the end of the cycle for the fixed-bed residue hydrotreatment processes result in sufficient formation of sediments to degrade the quality of a fuel oil, in particular a bunker oil, constituted in large part by a heavy fraction originating from a fixed-bed process for hydrotreatment residues. A person skilled in the art is familiar with the difference between a fixed bed and a slurry bed. A slurry bed is a bed in which the catalyst is sufficiently dispersed in the form of small particles for the latter to be in suspension in the liquid phase.

BRIEF DESCRIPTION OF THE INVENTION

In the context described above, the Applicant has developed a new process incorporating a stage of hydrocracking in permutable reactors allowing increased conversion with respect to the conventional processes for hydrotreatment of residues.

By "permutable reactors" is meant a set of at least two reactors, one reactor of which can be stopped, generally for regeneration or replacement of the catalyst or for maintenance while the other (or others) is (are) operating.

Surprisingly, it was found that, after fractionation of the hydrocarbon-containing fractions having a low sulphur content, such a process made it possible to obtain an increased quantity of distillates, and at least one liquid hydrocarbon-containing fraction advantageously being able to be used, wholly or in part, as a fuel oil or as a fuel-oil base. The new process also makes it possible to incorporate a stage of precipitation and separation of the sediments downstream of the hydrocracking stage in permutable reactors so as to obtain, after fractionation, at least one heavy fraction with a low sulphur content corresponding to the future recommendations of the IMO, but especially with a low sediment content, namely a sediment content after ageing of less than or equal to 0.1% by weight.

Another advantage of the new process incorporating a stage of precipitation and separation of the sediments downstream of a hydrocracking stage in permutable reactors, is that it becomes possible to operate these permutable hydrocracking reactors at an average temperature over the entire cycle that is higher than that of the reactors of the fixed-bed hydrotreatment section, thus resulting in a higher conversion without the formation of sediments, generally increased by the higher temperature, proving problematic for the quality of the product. Similarly, coking does not become problematic in the hydrocracking section, since the permutable reactors allow the replacement of the catalyst without stopping the unit.

For onshore applications such as thermal power stations for the production of electricity or the production of utilities, there are requirements on the sulphur content of the fuel oil, with less stringent requirements on the stability and sediment content than for the bunker oils intended for combustion in engines.

For certain applications, the process according to the invention can thus be implemented in the absence of stages e), f) and g), so as to obtain high-value conversion distillates, and a heavy hydrocarbon-containing fraction with a low sulphur content that can be used as a fuel oil or a fuel-oil base.

More precisely, the invention relates to a process for treating a hydrocarbon-containing feedstock containing at least one hydrocarbon-containing fraction having a sulphur content of at least 0.1% by weight, an initial boiling temperature of at least 340° C. and a final boiling temperature of at least 440° C., making it possible to obtain conversion products and a heavy hydrocarbon-containing fraction having a low sulphur content. This heavy hydrocarbon-containing fraction can be produced so that its sediment content after ageing is less than or equal to 0.1% by weight. Said process comprises at least the following stages:

a) a hydrodemetallization stage in permutable reactors in which the hydrocarbon-containing feedstock and hydrogen are brought into contact on a hydrodemetallization catalyst,
b) a stage of fixed-bed hydrotreatment of the effluent originating from stage a),
c) a stage of hydrocracking in permutable reactors of the effluent originating from stage b),
d) a stage of separation of the effluent originating from stage c), resulting in at least one gaseous fraction and a heavy liquid fraction,
e) a stage of precipitation of the sediments in which the heavy liquid fraction originating from separation stage d) is brought into contact with a distillate cut at least 20% by weight of which has a boiling temperature above or equal to 100° C., for a duration of less than 500 minutes, at a temperature comprised between 25 and 350° C., and a pressure less than 20 MPa,
f) a stage of physical separation of the sediments contained in the heavy liquid fraction originating from stage d),
g) a stage of recovery of the liquid hydrocarbon-containing fraction having a sediment content after ageing of less than or equal to 0.1% by weight consisting of separating the liquid hydrocarbon-containing fraction originating from stage f) from the distillate cut introduced during precipitation stage e).

One of the aims of the present invention is to propose a process coupling conversion and desulphurization of heavy petroleum feedstocks for the production of fuel oils and fuel-oil bases having a low sulphur content.

Another aim of the process is the production of bunker oils or bunker oil bases having a low sediment content after ageing of less than or equal to 0.1% by weight, this being made possible when stages e), f) and g) are implemented.

Another aim of the present invention is to produce jointly, by means of the same process, atmospheric distillates (naphtha, kerosene and diesel), vacuum distillates and/or light gases (C1 to C4). Naphtha- and diesel-type bases can be upgraded in the refinery for the production of automotive aviation fuels, such as for example superfuels, Jet fuels and gasoils.

DESCRIPTION OF FIG. 1

Figure 1:
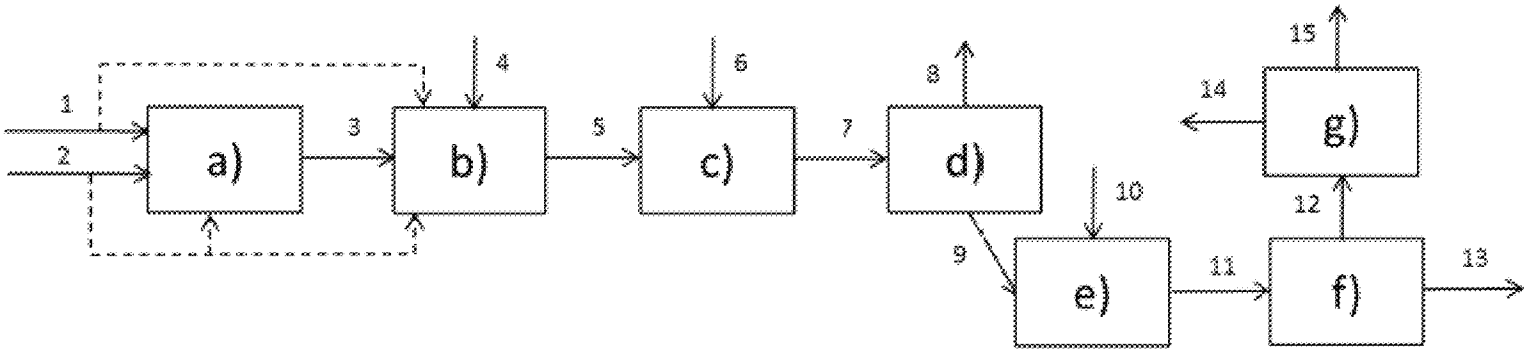
FIG. 1 shows a flow chart representing the implementation of the invention without limiting the scope thereof.

The hydrocarbon-containing feedstock (1) and hydrogen (2) are brought into contact in a hydrodemetallization stage a) in permutable reactors, into which hydrogen (2) can be introduced at the inlet of the first catalytic bed and between two beds of stage a).

The effluent (3) originating from hydrodemetallization stage a) in permutable guard reactors is sent to a fixed-bed hydrotreatment stage b) in which additional hydrogen (4) can be introduced at the inlet of the first catalytic bed and between two beds of stage b).

In the case of absence of stage a), the hydrocarbon-containing feedstock (1) and hydrogen (2) are introduced directly into hydrotreatment stage b). The effluent (5) originating from fixed-bed hydrotreatment stage b) is sent to a stage c) of hydrocracking in permutable guard reactors in which additional hydrogen (6) can be introduced at the inlet of the first catalytic bed and between two beds of stage c). The effluent (7) originating from hydrocracking stage c) is sent to a separation stage d) making it possible to obtain at least one light hydrocarbon-containing fraction (8) and a heavy fraction (9) containing compounds boiling at at least 350° C. This heavy fraction (9) is brought into contact with a distillate cut (10) during a precipitation stage e).

The effluent (11) constituted by a heavy fraction and sediments is treated in a physical separation stage f) making it possible to remove a fraction comprising sediments (13) and to recover a liquid hydrocarbon-containing fraction (12) having a reduced sediment content. The liquid hydrocarbon-containing fraction (12) is then treated in a stage g) of recovery, on the one hand, of the liquid hydrocarbon-containing fraction (15) having a sediment content after ageing of less than or equal to 0.1% by weight and, on the other hand, of a fraction (14) containing at least a part of the distillate cut introduced during stage e).

The liquid hydrocarbon-containing fraction (14) can be wholly or partly recycled to stage e) of precipitation of the sediments.

Stages e), f), g) are implemented either together, or independently of one another. This means that a process comprising for example only stage e) or stages e) and f) but not stage g) remains within the scope of the present invention.

Figure 2:
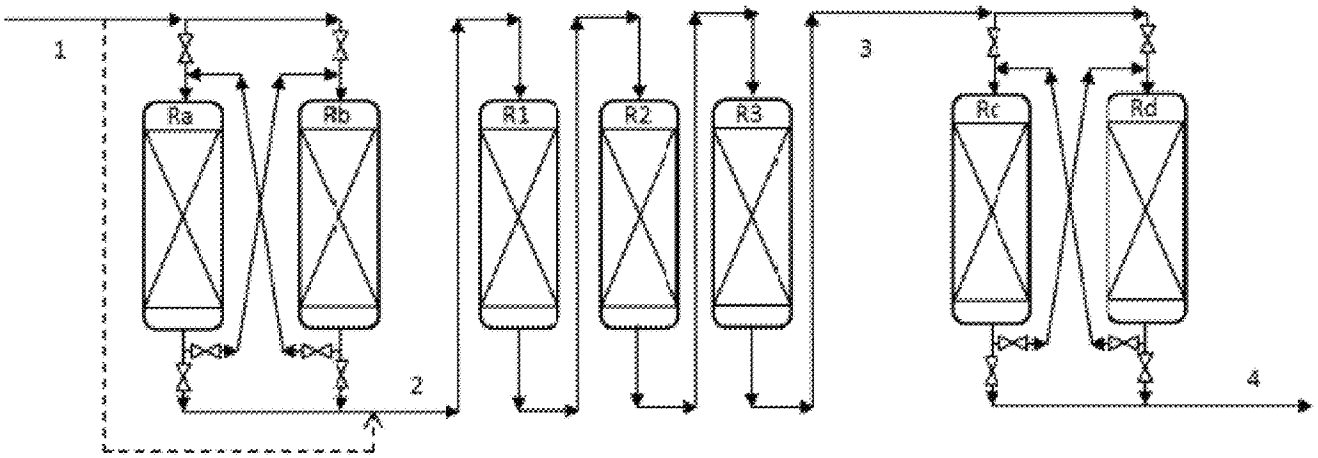
FIG. 2 shows a simplified flow chart representing the utilization of the series of reactors of the invention, without limiting the scope thereof.

Description of FIG. 2

FIG. 2 shows a simplified flow chart representing the utilization of the series of reactors of the invention, without limiting the scope thereof. In the interests of simplicity, only the reactors are shown, but it is understood that all the equipment necessary for operation is present (drums, pumps, exchangers, ovens, columns, etc.). Only the main flows containing the hydrocarbons are shown, but it is understood that the hydrogen-rich gas flows (top-up or recycle) can be injected at the inlet of each catalytic bed or between two beds.

The feedstock (1) enters a hydrodemetallization stage in permutable guard reactors constituted by reactors Ra and Rb. The effluent (2) from the hydrodemetallization stage in permutable guard reactors is sent to the fixed-bed hydrotreatment stage constituted by reactors R1, R2 and R3. The fixed-bed hydrotreatment reactors can for example be loaded with hydrodemetallization, transition and hydrodesulphuration catalysts respectively. The feedstock (1) can enter directly into the fixed-bed hydrotreatment section. The effluent (3) from the fixed-bed hydrotreatment stage is sent to the hydrocracking stage in permutable reactors constituted by reactors Rc and Rd.

In this configuration, the reactors are permutable in pairs, i.e. Ra is associated with Rb, and Rc is associated with Rd. Each reactor Ra, Rb, Rc, Rd can be taken offline so as to change the catalyst without stopping the rest of the unit. This changing of the catalyst (rinsing, unloading, reloading, sulphurization) is generally made possible by a conditioning section (not shown). The following table gives examples of sequences that can be carried out according to FIG. 2:

| | Hydrodemetallization permutable reactors | | | Fixed-bed hydrotreatment | | | Hydrocracking permutable reactors | | |
|---|---|---|---|---|---|---|---|---|---|
| sequences | offline | HDM1 | HDM2 | HDM | Transition | HDS | offline | HCK1 | HCK2 |
| 1 | — | Ra | Rb | R1 | R2 | R3 | — | Rc | Rd |
| 2 | Ra | — | Rb | R1 | R2 | R3 | — | Rc | Rd |
| 3 | — | Rb | Ra | R1 | R2 | R3 | — | Rc | Rd |
| 4 | — | Rb | Ra | R1 | R2 | R3 | Rc | — | Rd |
| 5 | — | Rb | Ra | R1 | R2 | R3 | — | Rd | Rc |
| 6 | Rb | | Ra | R1 | R2 | R3 | — | Rd | Rc |
| 7 | — | Ra | Rb | R1 | R2 | R3 | — | Rd | Rc |
| 8 | — | Ra | Rb | R1 | R2 | R3 | Rd | — | Rc |
| 9 | — | Ra | Rb | R1 | R2 | R3 | — | Rc | Rd |

Sequence 9 being identical to sequence 1 demonstrates the cyclical character of the proposed operation.

Similarly, there may be more than 2 permutable reactors in the hydrodemetallization section with permutable reactors or in the hydrocracking section with permutable reactors. Similarly, there may be more or less than 3 fixed-bed hydrotreatment reactors, representation by R1, R2 and R3 being given purely for purposes of illustration.

DETAILED DESCRIPTION OF THE INVENTION

The text hereinafter provides information on the feedstock and the different stages of the process according to the invention.

The Feedstock

The feedstock treated in the process according to the invention is advantageously a hydrocarbon-containing feedstock having an initial boiling temperature of at least 340° C. and a final boiling temperature of at least 440° C. Preferably, its initial boiling temperature is at least 350° C., preferentially at least 375° C., and its final boiling temperature is at least 450° C., preferentially at least 460° C., more preferentially at least 500° C., and even more preferentially at least 600° C.

The hydrocarbon-containing feedstock according to the invention can be selected from atmospheric residues, vacuum residues originating from direct distillation, crude oils, topped crude oils, deasphalting resins, asphalts or deasphalting pitches, residues originating from conversion processes, aromatic extracts originating from lubricant base production chains, bituminous sands or derivatives thereof, oil shales or derivatives thereof, source rock oils or derivatives thereof, used alone or in a mixture. In the present invention, the feedstocks being treated are preferably atmospheric residues or vacuum residues, or mixtures of these residues.

The hydrocarbon-containing feedstock treated in the process can contain, among other things, sulphur-containing impurities. The sulphur content can be at least 0.1% by weight, preferably at least 0.5% by weight, preferentially at least 1% by weight, more preferentially at least 4% by weight, even more preferentially at least 5% by weight.

The hydrocarbon-containing feedstock treated in the process can contain, among other things, metal impurities, in particular nickel and vanadium. The sum of the nickel and vanadium contents is generally at least 10 ppm, preferably at least 50 ppm, preferentially at least 100 ppm, more preferentially at least 150 ppm.

These feedstocks can advantageously be used as they are. Alternatively, they can be diluted with a co-feedstock. This co-feedstock can be a lighter hydrocarbon-containing fraction or mixture of lighter hydrocarbon-containing fractions, which can preferably be selected from the products originating from a fluid catalytic cracking (FCC) process, a light cut oil (or light cycle oil, LCO), a heavy cut oil (or heavy cycle oil, HCO), a decanted oil (DO), an FCC residue, a gasoil fraction, in particular a fraction obtained by atmospheric or vacuum distillation, such as for example vacuum gas oil, or also that can originate from another refining process such as coking or visbreaking.

The co-feedstock can also advantageously be one or more cuts originating from the process for liquefaction of coal or biomass, aromatic extracts, or any other hydrocarbon-containing cuts or also non-petroleum feedstocks such as pyrolysis oil. The heavy hydrocarbon-containing feedstock according to the invention can represent at least 50%, preferentially 70%, more preferentially at least 80%, and even more preferentially at least 90% by weight of the total hydrocarbon-containing feedstock treated by the process according to the invention.

In certain cases the co-feedstock can be introduced downstream of the first bed or of the subsequent beds, for example at the inlet of the fixed-bed hydrotreatment section, or also at the inlet of the fixed-bed hydrocracking section with permutable reactors.

The process according to the invention makes it possible to obtain conversion products, in particular distillates and a heavy hydrocarbon-containing fraction having a low sulphur content. This heavy hydrocarbon-containing fraction can be produced so that its sediment content after ageing is less than or equal to 0.1% by weight, this being made possible by the implementation of stages of precipitation and separation of the sediments.

Stage a) of Hydrodemetallization in Permutable Guard Reactors

During the hydrodemetallization stage a), the feedstock and hydrogen are brought into contact over a hydrodemetallization catalyst loaded into at least two permutable reactors, under hydrodemetallization conditions. This stage a) is preferentially implemented when the feedstock contains more than 50 ppm, or even more than 100 ppm of metals and/or when the feedstock comprises impurities capable of causing premature clogging of the catalytic bed, such as iron or calcium derivatives for example. The aim is to reduce the impurity content and thus to protect the downstream hydrotreatment stage from deactivation and clogging, hence the concept of guard reactors. These hydrodemetallization guard reactors are utilized as permutable reactors (PRS, or Permutable Reactor System technology) as described in patent FR2681871.

These permutable reactors are generally fixed beds situated upstream of the fixed-bed hydrotreatment section and equipped with lines and valves so that they can be permuted between one another, i.e. for a system with two permutable reactors Ra and Rb, Ra can be before Rb and vice-versa. Each reactor Ra, Rb can be taken offline so as to change the catalyst without stopping the rest of the unit. This changing of the catalyst (rinsing, unloading, reloading, sulphurization) is generally made possible by a conditioning section (set of equipment outside the main high-pressure loop). The permutation for changing the catalyst takes place when the catalyst is not sufficiently active (metals poisoning and coking) and/or the clogging results in too great a pressure drop.

According to a variant, there may be more than 2 permutable reactors in the hydrodemetallization section with permutable reactors.

During hydrodemetallization stage a), hydrodemetallization reactions take place (commonly known as HDM) but also hydrodesulphurization reactions (commonly known as HDS), hydrodenitrogenation reactions (commonly known as HDN), accompanied by hydrogenation, hydrodeoxygenation, hydrodearomatization, hydroisomerization, hydrodealkylation, hydrocracking, hydrodeasphalting reactions and the reduction of Conradson carbon. Stage a) is called hydrodemetallization due to the fact that it removes the majority of the metals from the feedstock.

Stage a) of hydrodemetallization in permutable reactors according to the invention can advantageously be implemented at a temperature comprised between 300° C. and 500° C., preferably between 350° C. and 430° C., and under an absolute pressure comprised between 5 MPa and 35 MPa, preferably between 11 MPa and 26 MPa, for preference between 14 MPa and 20 MPa. The temperature is usually adjusted as a function of the desired level of hydrodemetallization and the intended duration of treatment. Most frequently, the hourly space velocity of the hydrocarbon-containing feedstock, commonly called HSV and defined as being the volumetric flow rate of the feedstock divided by the total volume of the catalyst, can be comprised within a range from 0.1 $h^{-1}$ to 5 $h^{-1}$, preferentially from 0.15 $h^{-1}$ to 3 $h^{-1}$, and more preferentially from 0.2 $h^{1}$ to 2 $h^{-1}$.

The quantity of hydrogen mixed with the feedstock can be comprised between 100 et 5000 normal cubic metres ($Nm^3$) per cubic metre ($m^3$) of liquid feedstock, preferentially between 200 $Nm^3/m^3$ and 2000 $Nm^3/m^3$ and more preferentially between 300 $Nm^3/m^3$ and 1000 $Nm^3/m^3$. Stage a) of hydrodemetallization in permutable reactors can be carried out industrially in at least two fixed-bed reactors and preferentially with liquid downflow.

The hydrodemetallization catalysts used are preferably known catalysts. These may be granular catalysts comprising, on a support, at least one metal or metal compound having a hydrodehydrogenating function. These catalysts can advantageously be catalysts comprising at least one group VIII metal, generally selected from the group constituted by nickel and cobalt, and/or at least one group VIB metal, preferably molybdenum and/or tungsten. For example a catalyst comprising 0.5 to 10% by weight of nickel, preferably 1 to 5% by weight of nickel (expressed as nickel oxide NiO) and 1 to 30% by weight of molybdenum, preferably 3 to 20% by weight of molybdenum (expressed as molybdenum oxide $MoO_3$) on a mineral support can be used. This support can for example be selected from the group constituted by alumina, silica, silica-aluminas, magnesium oxide, clays and mixtures of at least two of these minerals. Advantageously, this support can contain other doping compounds, in particular oxides selected from the group constituted by boron oxide, zirconia, cerite, titanium oxide, phosphoric anhydride and a mixture of these oxides. An alumina support is used most often, and an alumina support doped with phosphorus and optionally boron very often. When phosphoric anhydride $P_2O_5$ is present, its concentration is less than 10% by weight. When boron trioxide $B_2O_5$ is present, its concentration is less than 10% by weight. The alumina used can be a γ (gamma) or η (eta) alumina. This catalyst is most often in the form of extrudates. The total oxide content of group VIB and VIII metals can be from 5% to 40% by weight, preferentially 5% to 30% by weight, and the weight ratio expressed as metallic oxide between a group VIB metal (or metals) and a group VIII metal (or metals) is generally comprised between 20 and 1 and most often between 10 and 2.

Catalysts that can be used in stage a) of hydrodemetallization in permutable reactors are for example indicated in patent documents EP 0113297, EP 0113284, U.S. Pat. Nos. 5,221,656, 5,827,421, 7,119,045, 5,622,616 and 5,089,463.

Fixed-Bed Hvdrotreatment Stage b)

The effluent originating from hydrodemetallization stage a) is introduced, optionally with hydrogen, into a fixed-bed hydrotreatment stage b) in order to be brought into contact over at least one hydrotreatment catalyst. In the absence of hydrodemetallization stage a) in permutable guard reactors, the feedstock and the hydrogen are introduced directly in fixed-bed hydrotreatment stage b) in order to be brought into contact over at least one hydrotreatment catalyst. This or these hydrotreatment catalyst(s) are utilized in at least one fixed-bed reactor, preferentially with liquid downflow.

By hydrotreatment, commonly known as HDT, is meant the catalytic treatments with supply of hydrogen making it possible to refine the hydrocarbon-containing feedstocks, i.e. to substantially reduce their content of metals, sulphur and other impurities, while improving the hydrogen-to-carbon ratio of the feedstock and converting the feedstock more or less partially into lighter cuts. Hydrotreatment comprises in particular hydrodesulphurization reactions (commonly known as HDS), hydrodenitrogenation reactions (commonly known as HDN), and hydrodemetallization reactions (commonly known as HDM) accompanied by hydrogenation, hydrodeoxygenation, hydrodearomatization, hydroisomerization, hydrodealkylation, hydrocracking, hydrodeasphalting reactions and the reduction of Conradson carbon.

According to a preferred variant, hydrotreatment stage b) comprises a first hydrodemetallization (HDM) stage b1) carried out in one or more fixed-bed hydrodemetallization zones and a subsequent second hydrodesulphurization (HDS) stage b2) carried out in one or more fixed-bed hydrodesulphurization zones. During said first stage hydrodemetallization b1), the effluent from stage a), or the feedstock and hydrogen in the absence of stage a), are brought into contact over a hydrodemetallization catalyst under hydrodemetallization conditions, then during said second hydrodesulphurization stage b2), the effluent from the first hydrodemetallization stage b1) is brought into contact with a hydrodesulphurization catalyst, under hydrodesulphurization conditions. This process, known as HYVAHL-F™ is for example described in U.S. Pat. No. 5,417,846.

A person skilled in the art will easily understand that in hydrodemetallization stage b1, hydrodemetallization reactions are carried out, but also, in parallel, a part of the other hydrotreatment reactions, and in particular hydrodesulphurization and hydrocracking reactions. Similarly, in hydrodesulphurization stage b2, hydrodesulphurization reactions are carried out, but also, in parallel, a part of the other hydrotreatment reactions, and in particular hydrodemetallization and hydrocracking.

A person skilled in the art sometimes defines a transition zone in which all the types of hydrotreatment reactions take place. According to another variant, hydrotreatment stage b) comprises a first hydrodemetallization (HDM) stage b1) carried out in one or more fixed-bed hydrodemetallization zones, a subsequent second transition stage b2) carried out in one or more fixed-bed transition zones, and a subsequent third hydrodesulphurization (HDS) stage b3) carried out in one or more fixed-bed hydrodesulphurization zones. During said first hydrodemetallization stage b1), the effluent from stage a), or the feedstock and hydrogen in the absence of stage a), are brought into contact over a hydrodemetallization catalyst under hydrodemetallization conditions, then during said second transition stage b2), the effluent from the first hydrodemetallization stage b1) is brought into contact with a transition catalyst, under transition conditions, then during said third hydrodesulphurization stage b3), the effluent from the second transition stage b2) is brought into contact with a hydrodesulphurization catalyst, under hydrodesulphurization conditions.

Hydrodemetallization stage b1) according to the above variants is particularly necessary in the case of absence of hydrodemetallization stage a) in permutable guard reactors so as to treat the impurities and protect the downstream catalysts. The need for a hydrodemetallization stage b1) according to the above variants in addition to hydrodemetallization stage a) in permutable guard reactors is justified when the hydrodemetallization carried out during stage a) is not sufficient to protect the catalysts of stage b), in particular the hydrodesulphurization catalysts.

Hydrotreatment stage b) according to the invention is implemented under hydrotreatment conditions. It can advantageously be implemented at a temperature comprised between 300° C. and 500° C., preferably between 350° C. and 430° C., and under an absolute pressure comprised between 5 MPa and 35 MPa, preferably between 11 MPa and 26 MPa, for preference between 14 MPa and 20 MPa. The temperature is usually adjusted as a function of the desired level of hydrotreatment and the intended duration of treatment. Most frequently, the hourly space velocity of the hydrocarbon-containing feedstock, commonly called HSV and defined as being the volumetric flow rate of the feedstock divided by the total volume of the catalyst, can be comprised within a range from 0.1 $h^{-1}$ to 5 $h^{-1}$, preferentially from 0.1 $h^{-1}$ to 2 $h^{-1}$, and more preferentially from 0.1 $h^{-1}$ to 1 $h^{-1}$. The quantity of hydrogen mixed with the feedstock can be comprised between 100 et 5000 normal cubic metres ($Nm^3$) per cubic metre ($m^3$) of liquid feedstock, preferentially between 200 $Nm^3/m^3$ and 2000 $Nm^3/m^3$ and more preferentially between 300 $Nm^3/m^3$ and 1500 $Nm^3/m^3$. Hydrotreatment stage b) can be carried out industrially in one or more reactors with a liquid downflow.

The hydrotreatment catalysts used are preferably known catalysts. These may be granular catalysts comprising, on a support, at least one metal or metal compound having a hydrodehydrogenating function. These catalysts can advantageously be catalysts comprising at least one group VIII metal, generally selected from the group constituted by nickel and cobalt, and/or at least one group VIB metal, preferably molybdenum and/or tungsten. For example a catalyst comprising from 0.5 to 10% by weight of nickel, preferably 1 to 5% by weight of nickel (expressed as nickel oxide NiO) and 1 to 30% by weight of molybdenum, preferably 3 to 20% by weight of molybdenum (expressed as molybdenum oxide $MoO_3$) on a mineral support can be used. This support can for example be selected from the group constituted by alumina, silica, silica-aluminas, magnesium oxide, clays and mixtures of at least two of these minerals.

Advantageously, this support can contain other doping compounds, in particular oxides selected from the group constituted by boron oxide, zirconia, cerite, titanium oxide, phosphoric anhydride and a mixture of these oxides. An alumina support is used most often, and a support of alumina doped with phosphorus and optionally boron very often. When phosphoric anhydride $P_2O_5$ is present, its concentration is less than 10% by weight. When boron trioxide $B_2O_5$ is present, its concentration is less than 10% by weight. The alumina used can be a γ (gamma) or η (eta) alumina. This catalyst is most often in the form of extrudates. The total oxide content of group VIB and VIII metals can be from 3 to 40% by weight and preferentially 5 to 30% by weight, and the weight ratio expressed as metallic oxide between a metal (or metals) of group VIB and a metal (or metals) of group VIII is generally comprised between 20 and 1 and most often between 10 and 2.

In the case of a hydrotreatment stage including a hydrodemetallization (HDM) stage b1), then a hydrodesulphurization (HDS) stage b2), specific catalysts adapted to each stage are preferably used. Catalysts that can be used in hydrodemetallization stage b1) are for example indicated in patent documents EP 0113297, EP 0113284, U.S. Pat. Nos. 5,221,656, 5,827,421, 7,119,045, 5,622,616 and 5,089,463. Catalysts that can be used in hydrodesulphurization stage b2) are for example indicated in patent documents EP 0113297, EP 0113284, U.S. Pat. Nos. 6,589,908, 4,818,743, or U.S. Pat. No. 6,332,976. A mixed catalyst, also called transition catalyst, that is active in hydrodemetallization and in hydrodesulphurization can also be used both for the hydrodemetallization section b1) and for the hydrodesulphurization section b2), as described in patent document FR 2940143.

In the case of a hydrotreatment stage including a hydrodemetallization (HDM) stage b1), then a transition stage b2), then a hydrodesulphurization (HDS) stage b3), specific catalysts adapted to each stage are preferably used. Catalysts that can be used in hydrodemetallization stage b1) are for example indicated in patent documents EP 0113297, EP 0113284, U.S. Pat. Nos. 5,221,656, 5,827,421, 7,119,045, 5,622,616 and 5,089,463. Catalysts that can be used in transition stage b2), active in hydrodemetallization and hydrodesulphurization, are for example described in patent document FR 2940143. Catalysts that can be used in hydrodesulphurization stage b3) are for example indicated in patent documents EP 0113297, EP 0113284, U.S. Pat. Nos. 6,589,908, 4,818,743, or U.S. Pat. No. 6,332,976. A transition catalyst as described in patent document FR 2940143 can also be used for sections b1), b2) and b3).

Stage c) of Hydrocracking in Permutable Reactors

The effluent originating from hydrotreatment stage b) is introduced into a stage c) of hydrocracking in permutable reactors. Hydrogen can also be injected upstream of the different catalytic beds constituting the permutable hydrocracking reactors. In parallel with the desired thermal cracking and hydrocracking reactions in this stage, all types of hydrotreatment reactions (HDM, HDS, HDN, etc.) also take place. Specific conditions, in particular of temperature, and/or the use of one or more specific catalysts, make it possible to promote the desired cracking or hydrocracking reactions.

The reactors of hydrocracking stage c) are implemented as permutable reactors (PRS, for Permutable Reactor System technology) as described in patent FR2681871. These permutable reactors are equipped with lines and valves so they can be permuted with one another, i.e. for a system having two permutable reactors Rc and Rd, Rc can be before Rd and vice-versa. Each reactor Rc, Rd can be taken offline so as to change the catalyst without stopping the rest of the unit. This changing of the catalyst (rinsing, unloading, reloading, sulphurization) is generally made possible by a conditioning section (set of equipment outside the main high-pressure loop). The permutation for changing the catalyst takes place when the catalyst is not sufficiently active (mainly coking) and/or the clogging results in too great a pressure drop.

According to a variant, there may be more than 2 permutable reactors in the hydrocracking section with permutable reactors.

Hydrocracking stage c) according to the invention is implemented under hydrocracking conditions. It can advantageously be implemented at a temperature comprised between 340° C. and 480° C., preferably between 350° C. and 430° C., and under an absolute pressure comprised between 5 MPa and 35 MPa, preferably between 11 MPa and 26 MPa, for preference between 14 MPa and 20 MPa. The temperature is usually adjusted as a function of the desired level of hydrocracking and the duration of treatment envisaged. Preferably, the average temperature at the start of the cycle of stage c) of hydrocracking in permutable reactors is always greater by at least 5° C., preferably at least 10° C., more preferably at least 15° C. than the average temperature at the start of the cycle of hydrotreatment stage b). This difference may lessen during the cycle due to the increase in the temperature of hydrotreatment stage b) in order to compensate for catalyst deactivation. Overall, the average temperature over the whole of the cycle of stage c) of hydrocracking in permutable reactors is always greater by at least 5° C., than the average temperature over the whole of the cycle of hydrotreatment stage b).

Most frequently, the hourly space velocity of the hydrocarbon-containing feedstock, commonly called HSV, and defined as being the volumetric flow rate of the feedstock divided by the total volume of the catalyst, can be comprised within a range from 0.1 $h^{-1}$ to 5 $h^{-1}$, preferentially from 0.2 $h^{-1}$ to 2 $h^{-1}$, and more preferentially from 0.25 $h^{-1}$ to 1 $h^{-1}$. The quantity of hydrogen mixed with the feedstock can be comprised between 100 et 5000 normal cubic metres ($Nm^3$) per cubic metre ($m^3$) of liquid feedstock, preferentially between 200 $Nm^3/m^3$ and 2000 $Nm^3/m^3$ and more preferentially between 300 $Nm^3/m^3$ and 1500 $Nm^3/m^3$. Hydrocracking stage a) can be carried out industrially in at least two fixed-bed reactors, preferentially with liquid downflow.

The hydrocracking catalysts used can be hydrocracking or hydrotreatment catalysts. These may be granular catalysts in the form of extrudates or beads, comprising, on a support, at least one metal or metal compound having a hydrodehydrogenating function. These catalysts can advantageously be catalysts comprising at least one group VIII metal, generally selected from the group constituted by nickel and cobalt, and/or at least one group VIB metal, preferably molybdenum and/or tungsten. For example a catalyst comprising 0.5 to 10% by weight of nickel and preferably 1 to 5% by weight of nickel (expressed as nickel oxide NiO) and 1 to 30% by weight of molybdenum, preferably 5 to 20% by weight of molybdenum (expressed as molybdenum oxide $MoO_3$) on a mineral support can be used. This support can for example be selected from the group constituted by alumina, silica, silica-aluminas, magnesium oxide, clays and mixtures of at least two of these minerals.

Advantageously, this support can contain other doping compounds, in particular oxides selected from the group constituted by boron oxide, zirconia, cerite, titanium oxide, phosphoric anhydride and a mixture of these oxides. An alumina support is used most often, and a support of alumina doped with phosphorus and optionally boron very often. When phosphoric anhydride $P_2O_5$ is present, its concentration is less than 10% by weight. When boron trioxide $B_2O_5$ is present, its concentration is less than 10% by weight. The alumina used can be a $\gamma$ (gamma) or $\eta$ (eta) alumina. This catalyst is most often in the form of extrudates. The total content of oxides of group VIB and VIII metals can be from 5 to 40% by weight and preferentially 7 to 30% by weight, and the weight ratio expressed as metallic oxide between a group VIB metal (or metals) and a group VIII metal (or metals) is generally comprised between 20 and 1 and most often between 10 and 2.

Alternatively, the hydrocracking stage can in par advantageously use a bifunctional catalyst, having a hydrogenating phase in order to be able to hydrogenate the aromatics and provide the balance between the saturated compounds and the corresponding olefins and an acid phase which makes it possible to promote hydroisomerization and hydrocracking reactions. The acid function is advantageously supplied by supports with large surface areas (generally 100 to 800 $m^2 \cdot g^{-1}$) having a surface acidity, such as halogenated aluminas (chlorinated or fluorinated in particular), combinations of boron and aluminium oxides, amorphous silica-aluminas and zeolites. The hydrogenating function is advantageously supplied either by one or more metals from group VIII of the periodic table, such as iron, cobalt, nickel, ruthenium, rhodium, palladium, osmium, iridium and platinum, or by a combination of at least one metal from group VIB of the periodic table, such as molybdenum and tungsten and at least one non-noble metal from group VIII (such as nickel and cobalt). The catalyst should also advantageously have a high resistance to impurities and to asphaltenes due to the use of a heavy feedstock. Preferably, the bifunctional catalyst used comprises at least one metal selected from the group formed by the group VIII and VIIB metals, used alone or in a mixture, and a support comprising 10 to 90% by weight of a zeolite containing iron and 90 to 10% by weight of inorganic oxides. The group VIB metal used is preferably selected from tungsten and molybdenum and the group VIII metal is preferably selected from nickel and cobalt. The bifunctional catalyst is preferably prepared according to the preparation method described in Japanese patent application No. 2289 419 (IKC) or EP 0384186. Examples of this type of catalyst are described in patents JP 2966 985, JP 2908 959, JP 01 049399 and JP 61 028717, U.S. Pat. Nos. 4,446,008, 4,622,127, 6,342,152, EP 0,537,500 and EP 0622118.

According to another preferred variant, monofunctional catalysts and bifunctional catalysts of the alumina, amorphous or zeolytic silica-alumina type can be used in a mixture or in successive layers.

Use in the hydrocracking section of catalysts analogous to ebullating-bed hydrocracking catalysts or bifunctional catalysts is particularly advantageous.

According to a variant, the catalysts of the hydrocracking permutable reactors are characterized by high porosities, generally greater than 0.7 mL/g of total porosity, and the microporosity (i.e. the volume of the pores greater than 50 nm in size) of which constitutes a porous volume greater than 0.1 mL/g.

Prior to the injection of the feedstock, the catalysts used in the process according to the present invention are preferably subjected to an in-situ or ex-situ sulphurization treatment.

Stage d) of Separating the Hydrocracking Effluent

The process according to the invention can also comprise a separation stage d) making it possible to obtain at least one gaseous fraction and at least one heavy liquid fraction.

The effluent obtained at the end of hydrocracking stage c) comprises a liquid fraction and a gaseous fraction containing the gases, in particular $H_2$, $H_2S$, $NH_3$, and C1-C4 hydrocarbons. This gaseous fraction can be separated from the effluent using separation devices well known to a person skilled in the art, in particular using one or more separator drums capable of operating at different pressures and temperatures, optionally combined with a vapour or hydrogen stripping means and with one or more distillation columns. The effluent obtained at the end of hydrocracking stage c) is advantageously separated in at least one separator drum into at least one gaseous fraction et at least one heavy liquid fraction. These separators can for example be high pressure high temperature (HPHT) separators and/or high pressure low temperature (HPLT) separators.

After an optional cooling, this gaseous fraction is preferably treated in a hydrogen purification means so as to recover the hydrogen that was not consumed during the hydrotreatment and hydrocracking reactions. The hydrogen purification means can be amine washing, a membrane, a PSA-type system, or several of these means arranged in series. The purified hydrogen can then advantageously be recycled in the process according to the invention, after an optional recompression. Hydrogen can be introduced at the inlet of hydrodemetallization stage a) and/or at different points during hydrotreatment stage b) and/or at the inlet of hydrocracking stage c), and/or at different points during hydrocracking stage c), or even in the precipitation stage.

The separation stage d) can also comprise an atmospheric distillation and/or a vacuum distillation. Advantageously, separation stage d) also comprises at least one atmospheric distillation, in which the liquid hydrocarbon-containing fraction(s) obtained after separation is (are) fractionated by atmospheric distillation into at least one atmospheric distillate and at least one atmospheric residue fraction. The atmospheric distillate fraction can contain fuel bases (naphtha, kerosene and/or diesel) that can be upgraded commercially, for example in a refinery for the production of automotive and aviation fuel.

Moreover, separation stage d) of the process according to the invention can advantageously also comprise at least one vacuum distillation in which the liquid hydrocarbon-containing fraction(s) obtained after separation and/or the atmospheric residue fraction obtained after atmospheric distillation is (are) fractionated by vacuum distillation into at least one vacuum distillate fraction and at least one vacuum residue fraction. Preferably, separation stage d) comprises firstly an atmospheric distillation, in which the liquid hydrocarbon-containing fraction(s) obtained after separation is (are) fractionated by atmospheric distillation into at least one atmospheric distillate fraction and at least one atmospheric residue fraction, then a vacuum distillation in which the atmospheric residue fraction obtained after atmospheric distillation is fractionated by vacuum distillation into at least one vacuum distillate fraction and at least one vacuum residue fraction. The vacuum distillate fraction typically contains fractions of the vacuum gasoil type.

At least a part of the atmospheric residue fraction or a part of the vacuum residue fraction can be recycled in hydrocracking stage c). The atmospheric residue fraction and/or the vacuum residue fraction can be sent to a catalytic cracking process. The atmospheric residue fraction and/or the vacuum residue fraction can be used as fuel oil or as a fuel-oil base having a low sulphur content.

A part of the vacuum residue fraction and/or a part of the vacuum distillate fraction can be sent to a catalytic cracking or ebullating-bed hydrocracking stage.

A heavy liquid fraction part originating from separation stage d) can be used to form the distillate cut according to the invention used in stage e) of precipitation of the sediments.

Stage e): Precipitation of the Sediments

The heavy liquid fraction obtained at the end of separation stage d) contains organic sediments which result from the hydrotreatment and hydrocracking conditions. A part of the sediments is constituted by asphaltenes precipitated under the hydrotreatment and hydrocracking conditions and they are analyzed as existing sediments (IP375). The measurement uncertainty of the IP375 method is ±0.1 for contents of less than 3, and ±0.2 for contents greater than or equal to 3.

Depending on the hydrocracking conditions, the sediment content in the heavy liquid fraction varies. From an analytical point of view, a distinction is made between the existing sediments (IP375) and the sediments after ageing (IP390) which include the potential sediments. Now, severe hydrocracking conditions, i.e. when the conversion rate is for example greater than 30 or even 40 or 50%, cause the formation of existing sediments and of potential sediments. There is no conversion threshold at which these existing or potential sediments appear, since they result from the operating conditions (temperature, pressure, residence time, catalyst type, catalyst age, etc.) and also from the type of feedstock (origin, boiling range, mixtures of feedstocks, etc.

In order to obtain a fuel oil or a fuel-oil base corresponding to the recommendations of a sediment content after ageing (IP390) of less than or equal to 0.1%, the process according to the invention comprises a precipitation stage making it possible to improve the efficiency of separation of the sediments and thus to obtain stable fuel oils or fuel-oil bases, i.e. a sediment content after ageing of less than or equal to 0.1% by weight. The sediment content after ageing is measured by the IP390 method with a measurement uncertainty of ±0.1.

The precipitation stage according to the invention can be implemented according to various variants e1, e2, e3):

- A precipitation by destabilization e1) which consists of bringing the heavy liquid fraction originating from separation stage d) into contact with a distillate cut,
- A precipitation by oxidation e2) which consists of bringing the heavy liquid fraction originating from separation stage d) into contact with an oxidizing agent,
- A precipitation by oxidizing destabilization e3) which consists of bringing the heavy liquid fraction originating from separation stage d) into contact with a distillate cut and an oxidizing agent.

Variant of Precipitation by Destabilization e1)

The stage of precipitation by destabilization e1) according to the process of the invention comprises bringing the heavy liquid fraction originating from separation stage d) into contact with a distillate cut comprising hydrocarbons, generally obtained by distillation of crude oil or originating from a refining process. These hydrocarbons advantageously comprise paraffins, preferably at least 20% paraffins. These hydrocarbons typically have a boiling temperature under atmospheric conditions comprised between −42° C. and 400° C. These hydrocarbons are typically composed of more than 3 carbon atoms, generally between 3 and 40 carbon atoms. These may be for example cuts of the propane, butane, pentane, hexane, heptane, naphtha, kerosene, atmospheric gasoil or vacuum gasoil type, used alone or in a mixture. Preferably, at least 20% by weight of the distillate cut has a boiling temperature greater than or equal to 100° C., preferably greater than or equal to 120° C., more preferably greater than or equal to 150° C.

In a variant according to the invention, the distillate cut is characterized in that it comprises at least 25% by weight having a boiling temperature greater than or equal to 100° C., preferably greater than or equal to 120° C., more preferably greater than or equal to 150° C.

Advantageously, at least 5% by weight, or even 10% by weight of the distillate cut according to the invention has a boiling temperature of at least 252° C.

More advantageously, at least 5% by weight, or even 10% by weight of the distillate cut according to the invention has a boiling temperature of at least 255° C.

Said distillate cut can partially, or even wholly, originate from separation stage d) of the invention or from another refining process or also from another chemical process.

The use of the distillate cut according to the invention also has the advantage of dispensing with the majority use of high value-added cuts such as petrochemical cuts of the naphtha type.

In addition, use of the distillate cut according to the invention makes it possible to improve the yield of the heavy liquid fraction separated from the sediments. In fact, use of the distillate cut according to the invention makes it possible to maintain the solubilization of compounds that can be upgraded in the heavy liquid fraction to be separated from the sediments, unlike the use of cuts having lower boiling points, in which these compounds that can be upgraded are precipitated with the sediments.

The distillate cut can be used in a mixture with a cut of the naphtha type and/or a cut of the vacuum gasoil and/or vacuum residue type. Said distillate cut can be used in a mixture with the light fraction obtained at the end of stage d), the heavy fraction originating from stage d), these fractions being able to be used alone or in a mixture. In the case where the distillate cut according to the invention is mixed with another cut, a light fraction and/or a heavy fraction such as indicated above, the proportions are selected so that the resulting mixture conforms to the characteristics of the distillate cut according to the invention.

The ratio by weight between the distillate cut according to the invention and the heavy fraction obtained at the end of separation stage d) is comprised between 0.01 and 100, preferably between 0.05 and 10, more preferably between 0.1 and 5, and even more preferably between 0.1 and 2. When the distillate cut according to the invention is drawn off from the process, it is possible to accumulate this cut during a startup period so as to reach the desired ratio.

The distillate cut according to the invention can also originate in part from stage g) of recovery of the liquid hydrocarbon-containing fraction.

Advantageously, variant e1) is carried out in the presence of an inert gas such as dinitrogen and/or of a gas rich in hydrogen, preferably originating from the process of the invention, in particular from separation stage d).

Variant of Precipitation by Oxidation e2)

The stage of precipitation by destabilization e2) according to the process of the invention comprises bringing the heavy liquid fraction originating from separation stage d) into contact with a gaseous, liquid or solid oxidizing compound. The use of an oxidizing compound has the advantage of speeding up the precipitation process. By "oxidizing gas" is meant a gas that can contain dioxygen, ozone or nitrogen oxides, used alone or in a mixture, optionally as a complement to an inert gas. This oxidizing gas can be air or nitrogen-depleted air. By extension, an oxidizing gas can be a halogenated gas (dichloride for example) easily resulting in the formation of oxygen, for example in the presence of water. By "oxidizing liquid" is meant an oxygenated compound, for example water, a peroxide such as oxygenated water, a peracid or also a mineral oxidizing solution such as a solution of nitrate (ammonium nitrate for example) or permanganate (potassium permanganate for example) or chlorate or hypochlorite or persulphate or a mineral acid such as sulphuric acid. According to this variant, at least one gaseous, liquid or solid oxidizing compound is then mixed with the heavy liquid fraction originating from separation stage d) and the distillate cut according to the invention during the implementation of stage e) of precipitation of the sediments.

Variant of Precipitation by Oxidizing Destabilization e3)

The stage of precipitation by oxidizing destabilization e3) according to the process of the invention comprises bringing the heavy liquid fraction originating from separation stage d) into contact with a distillate cut as defined in variant e1) of precipitation by destabilization and a gaseous, liquid or solid oxidizing compound as defined in variant e2 of precipitation by oxidation. During variant e3), there can be a combination of different instances of bringing the heavy liquid fraction originating from separation stage d) into contact with at least one distillate cut and at least one oxidizing compound. These instances of bringing into contact can be successive or simultaneous so as to optimize the precipitation.

Precipitation stage e) according to the invention, implemented according to variants e1), e2) or e3) makes it possible to obtain all of the existing and potential sediments (by converting the potential sediments into existing sediments) so as to separate them more effectively and thus to reach the sediment content after ageing (IP390) of 0.1% by weight maximum.

Precipitation stage e) according to the invention, implemented according to variants e1), e2) or e3) is advantageously implemented for a residence time less than 500 minutes, preferably less than 300 minutes, more preferably less than 60 minutes, at a temperature between 25 and 350° C., preferably between 50 and 350° C., preferably between 65 et 300° C. and more preferably between 80 and 250° C. The pressure of the precipitation stage is advantageously less than 20 MPa, preferably less than 10 MPa, more preferentially less than 3 MPa and even more preferentially less than 1.5 MPa.

Precipitation stage e) according to the invention can be carried out using several items of equipment. A static mixer, an autoclave or a stirred tank can optionally be used so as to promote effective contact between the heavy liquid fraction obtained at the end of separation stage d) and the distillate cut according to the invention and/or the oxidizing compound according to the invention. One or more exchangers can be used before or after mixing the heavy liquid fraction obtained at the end of stage d) and the distillate cut according to the invention and/or the oxidizing compound according to the invention so as to reach the desired temperature. One or more container(s) can be used in series or in parallel such as a horizontal or vertical drum, optionally with a decantation function for removing a part of the distillate cut according to the invention and/or a part or all of the oxidizing compound according to the invention, or also a part of the heaviest solids. A stirred tank, optionally equipped with a double jacket allowing temperature regulation can also be used. This tank can be equipped with a draw-off device at the bottom for removing a part of the heaviest solids.

At the end of stage e), a hydrocarbon-containing fraction enriched with existing sediments is obtained. This fraction can at least in part comprise the distillate cut according to the invention during the implementation according to variants e1) or e3) by oxidizing destabilization. The hydrocarbon-containing fraction having a content enriched with sediments is sent into stage f) of physical separation of the sediments.

Stage f): Separation of the Sediments

The process according to the invention also comprises a stage f of physical separation of the sediments in order to obtain a liquid hydrocarbon-containing fraction.

The heavy liquid fraction obtained at the end of precipitation stage e) contains organic sediments of the precipitated asphaltenes type, which result from the hydrocracking conditions and from the precipitation conditions according to the invention.

Thus, at least a part of the heavy liquid fraction originating from precipitation stage e) is subjected to a separation of the sediments, which is a separation of the solid-liquid type, this separation being able to use a physical separation means selected from a filter, a separation membrane, a filtering bed of solids of the organic or inorganic type, an electrostatic precipitation, an electrostatic filter, a centrifugation system, a decantation, a centrifugal decanter, draw-off by means of an endless screw. A combination of several separation means of the same type or of a different type, in series and/or in parallel and being able to operate sequentially, can be used during this sediment separation stage f). One of these solid-liquid separation techniques can require the periodic use of a light rinsing fraction, originating from the process or not, making it possible for example to clean a filter and remove the sediments.

At the end of sediment separation stage f), a liquid hydrocarbon-containing fraction is obtained (having a sediment content after ageing of less than or equal to 0.1% by weight). This fraction having a reduced sediment content can comprise at least in part the distillate cut according to the invention introduced during stage e). In the absence of a distillate cut according to the invention, the liquid hydrocarbon-containing fraction having a reduced sediment content can advantageously serve as a fuel-oil base or as a fuel oil, in particular as a bunker-oil base or as a bunker oil, having a sediment content after ageing of less than 0.1% by weight.

Stage g): Recovery of the Liquid Hydrocarbon-Containing Fraction

According to the invention, the mixture originating from stage f) is advantageously introduced into a stage g) of recovery of the liquid hydrocarbon-containing fraction having a sediment content after ageing of less than or equal to 0.1% by weight consisting of separating the liquid hydrocarbon-containing fraction originating from stage f) from the distillate cut introduced during stage e). Stage g) is a separation stage similar to separation stage d). Stage g) can be implemented by means of items of equipment of the separator drum and/or distillation column type so as to separate on the one hand, at least a part of the distillate cut introduced during stage e), and on the other hand the liquid hydrocarbon-containing fraction having a sediment content after ageing of less than or equal to 0.1% by weight.

Advantageously, a part of the separated distillate cut from stage g) is recycled into precipitation stage e).

Said liquid hydrocarbon-containing fraction can advantageously serve as a fuel-oil base or as a fuel oil, in particular as a bunker oil base or as a bunker oil, having a sediment content after ageing of less than 0.1% by weight. Advantageously, said liquid hydrocarbon-containing fraction is mixed with one or more fluxing bases selected from the group constituted by the light cycle oils from a catalytic cracking process, the heavy cycle oils from a catalytic cracking process, the residue from a catalytic cracking process, a kerosene, a gasoil, a vacuum distillate and/or a decanted oil.

According to a particular embodiment, a part of the distillate cut according to the invention can be left in the liquid hydrocarbon-containing fraction having a reduced sediment content so that the viscosity of the mixture is directly that of a desired grade of fuel oil, for example 180 or 380 cSt at 50° C.

Fluxing

The liquid hydrocarbon-containing fractions according to the invention can, at least in part, advantageously be used as fuel-oil bases or as fuel oil, in particular as bunker-oil base or as bunker oil having a sediment content after ageing of less than or equal to 0.1% by weight.

By "fuel oil" is meant in the invention a hydrocarbon-containing fraction that can be used as a fuel. By "fuel-oil base" is meant in the invention a hydrocarbon-containing fraction that when mixed with other bases constitutes a fuel oil.

In order to obtain a fuel oil, the liquid hydrocarbon-containing fractions originating from stage d) or g) can be mixed with one or more fluxing bases selected from the group constituted by the light cycle oils from a catalytic cracking, the heavy cycle oils from a catalytic cracking, the residue from a catalytic cracking, a kerosene, a gasoil, a vacuum distillate and/or a decanted oil. Preferably, kerosene, gasoil and/or vacuum distillate produced in the process of the invention will be used.

A part of the fluxants can be introduced as being a part or the whole of the distillate cut according to the invention.

EXAMPLES

Example 1 (Not According to the Invention)

The feedstock is a mixture of atmospheric residues (AR) of Middle East origin. This mixture is characterized by a high quantity of metals (100 ppm by weight) and sulphur (4.0% by weight), as well as 7% of [370-].

The hydrotreatment process comprises the use of two permutable reactors Ra and Rb in the first stage of hydrodemetallization (HDM) upstream of a fixed-bed hydrotreatment section.

During the first so-called hydrodemetallization stage, the feedstock of hydrocarbons and hydrogen is passed over an HDM catalyst under HDM conditions, then during the subsequent second stage, the effluent from the first stage is passed over an HDT catalyst under HDT conditions. The HDM stage comprises an HDM zone with permutable beds (Ra, Rb). The HDT hydrotreatment stage comprises three fixed-bed reactors (R1, R2, R3).

The effluent obtained at the end of hydrotreatment stage is separated by flash in order to obtain a liquid fraction and a gaseous fraction containing the gases, in particular H2, H2S, NH3, and C1-C4 hydrocarbons. The liquid fraction is then stripped in a column, then fractionated in an atmospheric column, then a vacuum column, into several cuts (IBP-350° C., 350-520° C. and 520° C.+, cf. Table 5).

The two hydrodemetallization permutable reactors Ra and Rb are loaded with a hydrodemetallization catalyst. The three hydrotreatment reactors R1, R2 and R3 are loaded with hydrotreatment catalysts.

The process is carried out under a hydrogen partial pressure of 15 MPa, a temperature at the inlet of the reactor at the start of the cycle of 360° C. and at the end of the cycle of 420° C.

Table 2 below shows the residence time and the average temperatures over the cycle for the different sections. During the cycle, each permutable reactor Ra and Rb is taken offline for 3 weeks in order to renew the hydrodemetallization catalyst. These conditions were set according to the state of the art, for a duration of operation of 11 months and an HDM rate greater than 90%.

Table 1 below shows the hourly space velocity (HSV) for each catalytic reactor, and the corresponding average temperatures (WABT) obtained over the whole of the cycle according to the operating mode described.

TABLE 1

Operating conditions around the different sections

| | HSV (h-1) | WABT (° C.) |
|---|---|---|
| HDM permutable reactors | | |
| Ra | 2.00 | 395 |
| Rb | 2.00 | 386 |
| Fixed-bed hydrotreatment | | |
| R1 + R2 | 0.66 | 390 |
| R3 | 0.33 | 390 |
| Total | 0.18 | 390 |

The WABT is an average temperature throughout the height of the bed (optionally with a weighting that gives a different weight to a particular portion of the bed) and also averaged over time during the period of one cycle.

The yields obtained according to the example not according to the invention are presented in Table 4 for comparison with the yields shown in the example according to the invention.

Example 2 (According to the Invention)

The process according to the invention is operated in this example with the same feedstock, the same catalysts, and under the same operating conditions for the reactors of the hydrodemetallization stage and the reactors R1 and R2 of the hydrotreatment (HDT) stage b).

The process according to the invention comprises the use of two new hydrocracking permutable reactors denoted Rc and Rd, replacing a part of the reactor R3 that appears in the hydrotreatment (HDT) section of the prior art. Hydrocracking stage c) is carried out at high temperature downstream of fixed-bed hydrotreatment stage b) which comprises only two reactors R1 and R2.

Table 2 below gives an example of operation around the 4 permutable reactors Ra, Rb, Rc and Rd.

TABLE 2

Operations around the permutable reactors according to the invention

| Cycle stage (HDM permutable reactors) | | Cycle stage (HCK permutable reactors) | | Intervention |
|---|---|---|---|---|
| a | Ra + Rb | a' | Rc + Rd | — |
| b | Rb | | Rc + Rd | Ra |
| c | Ra + Rb | | Rc + Rd | — |
| | Ra + Rb | b' | Rd | Rc |
| | Ra + Rb | c' | Rc + Rd | — |
| d | Ra | | Rc + Rd | Rb |
| a | Ra + Rb | | Rc + Rd | — |
| | Ra + Rb | d' | Rc | Rd |
| | Ra + Rb | a' | Rc + Rd | — |

The effluent obtained at the end of stage c) is similar in terms of purification to that of Example 1, but is more converted.

The two reactors Rc and Rd of the hydrocracking stage c) are loaded with a hydrocracking catalyst.

The process is carried out under a hydrogen partial pressure of 15 MPa, a temperature at the inlet of the reactor at the start of the cycle of 360° C. and at the end of the cycle of 420° C.

During the cycle, each permutable reactor Rc and Rd is taken offline for 3 weeks in order to renew the hydrocracking catalyst. Table 3 below shows the hourly space velocity (HSV) for each catalytic reactor, and the corresponding average temperatures (WABT) obtained over the whole of the cycle according to the operating mode described.

TABLE 3

Operating conditions around the different sections

| | HSV (h-1) | WABT (° C.) |
|---|---|---|
| HDM permutable reactors | | |
| Ra | 2.00 | 395 |
| Rb | 2.00 | 386 |
| Fixed-bed hydrotreatment | | |
| R1 + R2 | 0.66 | 390 |
| R3 | 1.67 | 390 |

TABLE 3-continued

| Operating conditions around the different sections | | |
|---|---|---|
| | HSV (h-1) | WABT (° C.) |
| HCK permutable reactors | | |
| Rc | 1.67 | 405 |
| Rd | 1.67 | 404 |
| Total | 0.23 | 394 |

Table 4 below presents the comparison of the yields and hydrogen consumption obtained according to the example not according to the invention and according the example according to the invention

TABLE 4

| Comparison of the average yields obtained during the cycle | | |
|---|---|---|
| | Example not according to the invention | Example according to the invention |
| Average WABT (° C.) | 390 | 394 |
| $H_2$ consumption | 1.67 | 1.77 |
| Yields | | |
| $H_2S$ | 3.94 | 3.94 |
| $NH_3$ | 0.24 | 0.24 |
| C1—C4 | 1.61 | 1.86 |
| IBP-350° C. | 17.9 | 18.8 |
| 350° C.-520° C. | 40.2 | 42.1 |
| 520° C.+ | 37.8 | 34.9 |
| Total | 101.67 | 101.77 |

It is therefore apparent, according to Tables 2, 3 and 4, that the process according to the invention incorporating a hydrocracking section (stage c) with permutable reactors allows an increase (+4° C.) in the average WABT of the cycle as well as an increase in the HSV. The WABT is the average temperature of the bed during one cycle.

The HSV is the ratio of the feedstock volume flow rate to the volume of catalyst contained in the reactor.

According to Table 4, the gain obtained in terms of WABT (+4° C.) is reflected in an increase in the yields of the cuts that are the most upgradable: +0.9 points on the [IBP-350° C.] cut and +1.9 points on the [350° C.-520° C.] cut.

During the cycle described according to the invention, the average temperature of the permutable beds (WABT) increases in order to compensate for the deactivation of all of the catalysts, despite the renewal of the permutable reactors.

As a consequence of the temperature increase, there may be formation of sediments that can be detrimental, depending on the use of the heavy cut (bunker oil for example).

In the example according to the invention, the sediment content after ageing (IP390) in the atmospheric residue (350° C.+) is greater than 0.1% by weight in the part of the cycle where the WABT of the hydrocracking permutable reactors is greater than 402° C.

In this case, the atmospheric residue (constituted by the 350-520° C. cut and the 520° C.+ cut) is subjected to a stage of precipitation and separation of the sediments according to two variants:

Precipitation by Destabilization

The atmospheric residue is mixed with a distillate cut which is a gasoil cut originating from the process (150-350° C.) in 50/50 vol/vol proportions at 80° C. for 5 minutes. The mixture is then filtered in order to remove the precipitated sediments then the liquid fraction having a reduced sediment content (IP390 less than 0.1% by weight) is distilled so as to recover the distillates cut (150-350) on the one hand, and the atmospheric residue (350+) having a reduced sediment content (IP390 less than 0.1% by weight) on the other hand.

Precipitation by Oxidation

The atmospheric residue is brought into contact in an autoclave with air under 2 bar oxygen pressure and under stirring for 6 h at 200° C. After decompression, the atmospheric residue is then filtered in order to remove the sediments precipitated and obtain the liquid fraction having a reduced sediment content (IP390 less than 0.1% by weight). The atmospheric residues (constituted by the 350-520° C. cut and the 520° C.+ cut) recovered after precipitation by destabilization and precipitation by oxidation have a viscosity of 280 cSt at 50° C. They also have a sediment content after ageing of less than 0.1% by weight and a sulphur content of less than 0.5% S. According to standard ISO8217, these atmospheric residues can be sold as residual-type marine fuel of the grade RMG 380. Due to the sulphur content of less than 0.5% by weight, these marine fuels will be able to be used outside of the SECA zones after 2020-25 without the ships being equipped with an exhaust scrubber device.

The invention claimed is:

1. Continuous process for treating a hydrocarbon-containing feedstock containing at least one hydrocarbon-containing fraction having a sulphur content of at least 0.1% by weight, an initial boiling temperature of at least 340° C. and a final boiling temperature of at least 440° C., the process comprising the following stages:

a) a hydrodemetallization stage in which at least two permutable reactors are utilized at a temperature comprised between 300° C. and 500° C., and under an absolute pressure comprised between 5 MPa and 35 MPa, in the presence of the hydrocarbon-containing feedstock and hydrogen, and of a hydrodemetallization catalyst; by "permutable reactors" is meant a set of at least two reactors, one reactor of which can be stopped, generally for regeneration or replacement of the catalyst or for maintenance, while the other (or others) is (are) operating, b) a fixed-bed hydrotreatment stage comprising at least one reactor in which the effluent originating from stage a) when this exists, or the hydrocarbon-containing feedstock directly when stage a) does not exist, is brought into contact with at least one hydrotreatment catalyst at a temperature comprised between 300° C. et 500° C. and under an absolute pressure comprised between 5 MPa et 35 MPa, c) a fixed-bed hydrocracking stage in which at least two permutable reactors are implemented at a temperature comprised between 340° C. and 480° C., and under an absolute pressure comprised between 5 MPa and 35 MPa, in the presence of the effluent originating from stage b), and a hydrocracking catalyst, d) a stage of separation of the effluent originating from stage c), in order to obtain at least one gaseous fraction and at least one heavy liquid fraction, e) a stage of precipitation of the sediments contained in the heavy liquid fraction originating from stage d) which can be carried out according to 3 variants called destabilization (e1), oxidation (e2), or oxidizing destabilization (e3), the operating conditions common to the three variants being the following:
residence time less than 60 minutes,
temperature between 80 and 250° C.,
pressure less than 1.5 MPa, f) a stage of physical separation of the sediments of the heavy liquid fraction originating from stage e) of precipitation in order to obtain a fraction containing the sediments, and a liquid hydrocarbon-containing fraction having a reduced sediment content, g) a stage of recovery of a liquid hydrocarbon-containing fraction having a sediment content after ageing of less than or equal to 0.1% by weight consisting of separating the liquid hydrocarbon-containing fraction having a reduced sediment content originating from stage f) from the distillate cut introduced during stage e) and which is recycled to said stage e).

2. Process for the treatment of a hydrocarbon-containing feedstock according to claim 1, in which the hydrodemetallization stage a) is conducted under the following operating conditions:

temperature preferably comprised between 350° C. and 430° C., absolute pressure comprised between 11 MPa and 26 MPa, and volumetric flow rate of the feedstock is between 0.1 $h^{-1}$ and 5 $h^{-1}$.

3. Process for the treatment of a hydrocarbon-containing feedstock according to claim 1, in which the hydrodemetallization stage a) uses a hydrodemetallization catalyst comprising from 0.5 to 10% by weight of nickel (expressed as nickel oxide NiO) and from 1 to 30% by weight of molybdenum (expressed as molybdenum oxide $MoO_3$) on a mineral support.

4. Process for the treatment of a hydrocarbon-containing feedstock according to claim 1, in which hydrotreatment stage b) is carried out at a temperature comprised between 350° C. and 430° C., and under an absolute pressure comprised between 14 MPa and 20 MPa.

5. Process for the treatment of a hydrocarbon-containing feedstock according to claim 1, in which the hydrotreatment stage b) uses a catalyst comprising from 0.5 to 10% by weight of nickel (expressed as nickel oxide NiO) and from 1 to 30% by weight of molybdenum (expressed as molybdenum oxide $MoO_3$) on a mineral support selected from the group constituted by alumina, silica, silica-aluminas, magnesium oxide, clays and mixtures of at least two of these minerals.

6. Process for the treatment of a hydrocarbon-containing feedstock according to claim 1, in which hydrocracking stage c) is carried out at a temperature comprised between 350° C. and 430° C., and under an absolute pressure comprised between 14 MPa and 20 MPa.

7. Process for the treatment of a hydrocarbon-containing feedstock according to claim 1, in which hydrocracking stage c) uses a catalyst comprising from 0.5 to 10% by weight of nickel (expressed as nickel oxide NiO) and from 1 to 30% by weight of molybdenum (expressed as molybdenum oxide $MoO_3$) on a mineral support selected from the group constituted by alumina, silica, silica-aluminas, magnesium oxide, clays and mixtures of at least two of these minerals.

8. Process for the treatment of a hydrocarbon-containing feedstock according to claim 1, in which separation stage d) comprises at least one atmospheric distillation which makes it possible to obtain at least one atmospheric distillate fraction and at least one atmospheric residue fraction.

9. Process for the treatment of a hydrocarbon-containing feedstock according to claim 1, in which separation stage d) comprises at least one vacuum distillation which makes it possible to obtain at least one vacuum distillate fraction and at least one vacuum residue fraction.

10. Process for the treatment of a hydrocarbon-containing feedstock according to claim 1, in which stage e) of precipitation of the sediments is carried out by destabilization, i.e. by bringing the heavy liquid fraction originating from separation stage d) into contact with a distillate cut comprising from 3 to 40 carbon atoms, and more precisely at least 20% by weight of which has a boiling temperature greater than or equal to 150° C.

11. Process for the treatment of a hydrocarbon-containing feedstock according to claim 1, in which the distillate cut used for bringing into contact with the heavy liquid fraction originating from stage d) is selected from the following cuts used alone or in a mixture: cuts of the propane, butane, pentane, hexane, heptane, naphtha or kerosene type, atmospheric gasoil or vacuum gasoil.

12. Process for the treatment of a hydrocarbon-containing feedstock according to claim 1, in which stage e) of precipitation of the sediments is carried out according to a variant known as "by oxidation", i.e. by bringing the heavy liquid fraction originating from separation stage d) into contact with a gaseous, liquid or solid oxidizing compound, for example a peroxide such as oxygenated water, or also a mineral oxidizing solution such as a solution of potassium permanganate or a mineral acid such as sulphuric acid.

13. Process for the treatment of a hydrocarbon-containing feedstock according to claim 1, in which stage e) of precipitation of the sediments is carried out according to a variant known as oxidizing destabilization i.e. by bringing the heavy liquid fraction originating from separation stage d) into contact with a distillate cut as defined in the variant of precipitation by destabilization and a gaseous, liquid or solid oxidizing compound as defined in the variant of precipitation by oxidation.

14. Process for the treatment of a hydrocarbon-containing feedstock according to claim 1, in which stage f) of physical separation of the sediments uses a physical separation means selected from a filter, a separation membrane, a filtering bed of organic- or inorganic-type solids, electrostatic precipitation, an electrostatic filter, a centrifugation system, a centrifugal decanter, a draw-off by means of an endless screw.

15. Process for the treatment of a hydrocarbon-containing feedstock according to claim 1, in which stage g) of recovery of the liquid hydrocarbon-containing fraction having a sediment content after ageing of less than or equal to 0.1% by weight consists of separating the liquid hydrocarbon-containing fraction having a reduced sediment content originating from stage f) from the distillate cut introduced during stage e), which is recycled to stage e).

* * * * *